United States Patent [19]

Spence

[11] 4,113,443

[45] Sep. 12, 1978

[54] ANTISTATIC ADDITIVES

[75] Inventor: J. Ronald Spence, Warrenville, Ill.

[73] Assignee: Standard Oil Company (Indiana), Chicago, Ill.

[21] Appl. No.: 810,291

[22] Filed: Jun. 27, 1977

[51] Int. Cl.[2] ..... C10L 1/24

[52] U.S. Cl. ..... 44/72; 252/8.75; 260/513 N; 44/DIG. 2

[58] Field of Search ..... 44/72; 260/513 N; 252/8.75

[56] References Cited

U.S. PATENT DOCUMENTS

| | | | |
|---|---|---|---|
| 1,944,300 | 1/1934 | Ott et al. | 260/513 N |
| 2,721,875 | 10/1955 | Dickert, Jr. et al. | 260/513 N |
| 2,806,056 | 9/1957 | Feichtinger | 260/513 N |
| 3,826,633 | 7/1974 | Coon | 44/72 |

*Primary Examiner*—Winston A. Douglas
*Assistant Examiner*—Mrs. Y. Harris-Smith
*Attorney, Agent, or Firm*—Mark J. DiPietro; Arthur G. Gilkes; William T. McClain

[57] ABSTRACT

The product of the reaction of an amine, an olefin and sulfur trioxide, or sulfur trioxide complex, is an effective ashless antistatic agent for hydrocarbons. A small amount of the antistatic agent, when added to hydrocarbons, increases the conductivity of the hydrocarbon. The increased conductivity of the hydrocarbon conducts away any static charges that may be generated on the hydrocarbon and thus prevents the buildup of the static charges. The antistatic additive is represented by the general formula $$\begin{array}{l} R_1CH\ CH_2{-}SO_3H \\ \quad\ \ \vert \\ \quad HNR_2 \end{array}$$

where $R_1$ is a hydrocarbon group of less than 24 carbon atoms and $R_2$ is hydrocarbon group with less than 18 carbons, or ammonia.

11 Claims, No Drawings

ANTISTATIC ADDITIVES

BACKGROUND OF THE INVENTION

1. Field of the Invention

This invention relates to compositions of hydrocarbons. Particularly, this invention relates to additives which reduce the tendency of certain hydrocarbons to generate and hold static electric charges.

2. Description of the Prior Art

Generation of static electricity on hydrocarbons is very dangerous. Numberous explosions and fires have been caused by sparks resulting from static charges generated on hydrocarbons. Commonly, static charges are generated on materials which have very low conductivities. Low conductivities result from the general purity of many hydrocarbons. Commonly, hydrocarbons are materials which have low conductivities and are susceptible to static charge generation. Aviation jet fuel, for example, commonly can have conductivity of less than one picosiemen. A minimum conductivity of 50 picosiemens is generally necessary to dissipate the static charges generated on the hydrocarbon.

Static charges can be built up during storage and transfer of fluid hydrocarbons in metal pipes and containers. If the conductivity of the hydrocarbon is high, the static charge dissipates quickly. When conductivities are low, the static charge dissipates very slowly. Sparks occur when the static is generated faster than the charge can be dissipated. Once the voltage of the static charge passes a certain level, called the "breakdown potential," about 30,000 volts, a spark occurs.

A number of ashless antistatic agents are known. Many antistatic agents are complex mixtures of amines, hydrocarbons, sulfur compounds, and assorted polymers. Other antistatic agents are copolymers of alpha-olefins, sulfur dioxide, and maleic anhydride. Still other antistatic additives are copolymers of alpha olefins and sulfur dioxide combined with polyamines.

Many antistatic agents are unstable chemicals which decompose and lose the antistatic effect. Other antistatic agents are commonly adsorbed out of the fuel by container walls, thus dangerously lowering the hydrocarbon conductivity. Typical antistatic additives are used at concentrations from 0.1 to 10 ppm based on the hydrocarbon. Many antistatic additives are produced from expensive chemical intermediates which are wasted by poor product yields. Thus a need for an antistatic agent which has improved properties was needed.

Numerous materials have been suggested in the prior art as antistatic agents. Examples of these agents are found in U.S. Pat. Nos. 3,844,732, 3,917,466, and 3,991,079. U.S. Pat. No. 3,844,732 discloses a fuel composition comprising a major amount of a liquid hydrocarbonaceous fuel and in an amount sufficient to provide engine cleanliness a hydrocarbylaminomethylenesulfonic acid, wherein said hydrocarbyl group contains at least 30 carbon atoms.

U.S. Pat. No. 3,991,079 discloses compositions made by reaction (A) an acylated amino hydrocarbyl sulfonic acid having an acyl portion containing a substantially saturated hydrocarbyl substituted of at least about 12 carbon atoms and bonded to the amino hydrocarbyl sulfonic acid through an acyl, acylimidoyl or acyloxy linkage, (B) a heterocyclic reagent such as an epoxide, episulfide or aziridine and (C) an amino compound having about 1 to about 400 carbon atoms or an organosulfide having 2 to about 50 carbon atoms are useful in fuels and lubricants as dispersants, anti-static agents and corrosion inhibitors.

U.S. Pat. No. 3,917,466 discloses anitstatic additive compositions for hydrocarbon fuels, the compositions comprising olefin-sulfur dioxide copolymers in combination with polymeric polyamines.

An object of the invention is to produce an antistatic agent additive which is stable in fuels. A further object of the invention is to have an additive which is effective at concentrations of less than 10 ppm. Still another object of the invention is a reaction of common industrial chemicals which proceeds to total conversion of starting materials to additive.

SUMMARY OF THE INVENTION

Disclosed are new compositions of matter comprising a fuel and an antistatic additive of the general formula

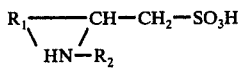

wherein the antistatic additive is present in a sufficient amount to increase the conductivity of the fuel to prevent static electric buildup, wherein the general formula $R_1$ is an hydrocarbon group of 1 to 24 carbon atoms, and $R_2$ is a hydrogen atom or a hydrocarbon group with less than 18 carbon atoms. Another composition of matter can be produced wherein $R_2$ is represented by the general formula $-[(CH_2)_x\text{-}NH]_yH$ wherein $x$ is a number ranging from 1 to 6 and $y$ is a number ranging from 1 to 5. Also $R_2$ may be represented by the general $-(CH_2)_z-HN-R_3$, wherein $z$ is a number ranging from 1 to 5 and $R_3$ is an alkyl or alkenyl group containing from 1 to 24 carbon atoms. Another aspect of this invention resides in a composition of matter of a hydrocarbon fuel containing an antistatic additive which is an Beta diethylene triamine derivative of a $C_{20}$ alkyl sulfonic acid represented by the formula

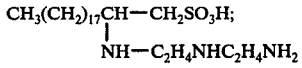

or resides in a composition of matter of a hydrocarbon fuel containing an antistatic additive which is a $C_{18}$ sulfonic acid substituted at the Beta position by a 1,6-hexane diamine represented by the formula:

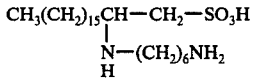

or resides in a composition of matter of a hydrocarbon fuel containing an antistatic additive which is a $C_{18}$ sulfonic acid substituted at the Beta position by a monohydrocarbyl derivative of 1,3-propane diamine represented by the formula

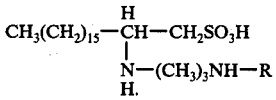

Also disclosed is the product of the process where an alpha olefin reacts with a sulfur dioxide complex at a mole ratio of 0.1–2.0:0.1–2.0 in an inert solvent at a temperature of about −10° C. or lower, this sulfur dioxide olefin adduct is then again reacted at a low temperature with about 0.1–2.0 moles of an amine, the temperature is raised to from about 10° to about 95° C. for about 1 minute to about 10 hours, preferably raised to a temperature of about 30° to about 50° C. for a period of 45 minutes to 2 hours. The solvent is removed and the antistatic agent is recovered. 1,4-dioxane, diethyl ether, and dimethyl formamide can be used as the complexing agent. The process preferably is carried out at an original temperature of from −30° to +20° C. with an alpha olefin of from about 8 to 24 carbon atoms, preferably about 18 to about 20 carbon atoms. The term amine means ammonia, N-alkyl-1,3-propylene diamine, N-alkenyl-1,3-propylene diamine, diethylene triamine, triethylene tetramine, and tetraethylene pentamine.

DESCRIPTION OF THE PREFERRED EMBODIMENTS

The disclosed additives are commonly produced from the reaction of sulfur dioxide, an amine and an alpha olefin or compounds containing an unsaturated bond. These addivites, when added to hydrocarbons, can increase the conductivity of the hydrocarbons. An effective amount of the additive commonly increases the conductivity of the hydrocarbon to greater than about 50 picosiemens.

One picosiemen is equivalent to $10^{-14}$MHO per centimeter, or $10^{-14}$ per OHM centimeter.

The alpha-olefins useful for the preparation of the antistatic agent are available commercially as pure or mixed olefins from petroleum cracking processes or from the polymerization of ethylene or other olefin monomers to a low degree of polymerization. Included are 1-hexene, 1-heptane, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonodecene, 1-eicosene, 1-heneicosene, 1-docosene, 1-tricosene and 1-tetracosene. Although branched-chain alkenes are useful, the straight-chain alpha olefins are preferred whether pure or in admixture with other straight-chain olefins.

By amine is meant polyamines, ammonia, or a "Duomeen". The term polyamine includes, for example, ethylene diamine, diethylene triamine, triethylene tetramine, tetraethylene pentamine, pentaethylene hexamine, etc. These compounds are discussed in some detail under the heading "Ethylene Amines" in "Encyclopedia of Chemical Technology," Kirk and Othmer, volume 5, pages 898–905, Interscience Publishers, New York (1950). Such compounds are prepared most conveniently by the reaction of ethylene dichloride with ammonia. This process results in the production of somewhat complex mixtures of ethylene amines, including cyclic condensation products such as piperazines. On the other hand, quite satisfactory products may be obtained also by the use of pure ethylene amines. Especially useful polyamines for reasons of economy as well as effectiveness are mixtures of ethylene amines prepared by the reaction of ethylene chloride and ammonia, having compositions which correspond to that of tetraethylene pentamine, triethylene tetra amine, and diethylene triamine. The various propylene polyamines are also useful.

The term "Duomeen" includes "Duomeen CD, T, O". These are commercial amine compounds made by the Arma-K Compnay. The compounds are made by hydrogenating the product of the reaction of an amine and acrylonitrile. The reaction product is an N-monoalkyl-1,3-propylene diamine. "Duomeen CD" is a cocoamine derivative of 1,3 propylene diamine. Cocoamine is a primary hydrocarbon amine where the hydrocarbon has 12 or 14 carbon atoms, with small amounts of $C_{16}$ or $C_{18}$ amines. "Duomeen O" is a primary amine derivative. The primary amine hydrocarbon group has 18 carbon atoms and is unsaturated at about the ninth carbon atom. "Duomeen T" is a tallow amine derivative. Tallow amine is a mixture of hydrocarbon amines. The mixture is about 60%$C_{18}$,10%$C_{16}$, 10%$C_{14}$ amines, with the balance minor amounts of other amines.

A field of specific applicability of the present invention is in the improvement of organic liquid compositions in the form of petroleum distillate fuel oils having an initial boiling point from about 75° to about 135° F. and an end boiling point from about 250° to about 1000° F. It should be noted, in this respect, that the term "distillate fuel oils" is not intended to be restricted to straight-run distillate fractions. These distillate fuel oils can be straight-run distillate fuel oils, catalytically or thermally cracked (including hydrocracked) distillate fuel oils, or mixtures of straight-run distillate fuel oils, naphthas and the like, with cracked distillate stocks. Moreover, such fuel oils can be treated in accordance with well-known commercial methods, such as acid or caustic treatment, hydrogenation, solvent refining, clay treatment, and the like.

Distillate fuel oils are characterized by their relatively low viscosity, pour point and the like. The principal property which characterizes these contemplated hydrocarbons, however, is their distillation range. As hereinbefore indicated, this range will lie between about 75° and about 1000° F. Obviously, the distillation range of each individual fuel oil will cover a narrower boiling range, falling nevertheless within the above-specified limits. Likewise, each fuel oil will boil substantially continuously, throughout its distillation range.

Particularly contemplated among the fuel oils are Nos. 1, 2 and 3 fuel oils, used in heating and as diesel fuel oils, used in heating and as diesel fuel oils, gasoline, turbine fuels and the jet combustion fuels, as previously indicated. The domestic fuel oils generally conform to the specifications set forth in ASTM Specification D396-48T. Specifications for diesel fuels are defined in ASTM Specifications D975-48T. Typical jet fuels are defined in Military Specification MIL-F-56248.

The reaction is carried out in a solvent inert to the complexing agent, sulfur dioxide, the alpha-olefin, and the amine. Sulfur dioxide is added to the complexing agent in the solvent at a ratio of 0.1–2.0:1, at a temperature below −10° C., preferably at −20° C. The complex of sulfur dioxide and complexing agent is stable at low temperatures. The alpha-olefin is added to the cooled sulfur dioxide containing mixture at a ratio of 0.1–2.0:1, while stirring at the low temperature. This produces an intermediate sultone where the sulfur dioxide reacts with the alpha olefin. This sultone is also stable at low temperatures.

The amine is added to the sultone-containing cooled mixture slowly at a mole ratio of 0.1–2:1. The temperature must remain low during this addition to keep the sultone intact. After this addition is complete, the mixture is raised to a temperature of about 10° to about 95° C., preferably from about 25° to about 65° C. for 1 minute to 10 hours, preferably for 1 hour. The solvent is evaporated and the antistatic agent is recovered.

Using this additive in hydrocarbon fuels has many advantages. Alkane amino sulfonic acids are simple to prepare. The additive can be made from starting materials that are commonly available in the industry. The reaction proceeds with very high yields, and with little waste of starting materials. The additives are soluble in the hydrocarbons in concentrations which produce safe conductivities. Commonly, the concentrations are less than 10 ppm, based on the fuel. Highly paraffinic fuels attain high activity at moderate concentrations of the additive. The additive is commonly stable in all hydrocarbons.

EXAMPLE 1

40.0 Grams or 0.45 moles of dry 1,4-dioxane, and 500 ml of dichloromethane were placed in a one-liter, three-neck flask equipped with a mechanical stirrer, thermometer, gas inlet tube, condenser, and gas bubbler. The contents were cooled to −20° C. During 1 hour, 17.0 grams or 0.01 mole of sulfur trioxide was distilled into the flask under a stream of argon. 50.0 Grams or 0.187 mole of a mixture of alpha olefins of from 18 carbon atoms to 20 carbon atoms was added rapidly to the while suspension and the mixture was stirred at approximately −5° to approximately −20° C. for 1 hour. 19.35 grams of American Chemical Society grade diethylene triamine were added at such a rate that the temperature in the flask did not exceed 8° C. The mixture was slowly heated to reflux ap approximately 45° C. and refluxed for 1 hour. A clear, amber solution resulted. Evaporation of the solvent at 100° C. under vacuum yielded 92 grams of an amber product, which is approximately 100 percent of the theoretical yield. An infrared spectrograph showed sulfonic acid, amide and amine moieties. The product was a clear, amber, viscous material.

EXAMPLE 2

300 ml of dichloromethane, and 70.0 grams or 0.79 moles of 1,4-dioxane and 100 grams or 0.397 moles of 1-octadecene was placed in a 1 liter, three-neck flask equipped with mechanical stirrer, thermometer, gas inlet tube, condenser and a gas bubbler. 31.7 Grams or 0.596 moles of sulfur trioxide was distilled into the flask in about 1 hour period. At 0° C., 53 grams or 0.36 moles of Duomene CD, which is a product of the Armak Company, of the general formula $R—NH_2(CH_2)_3NH_2$, where R is an alkyl of 12 to 14 carbon atoms, is added slowly keeping the temperature below 8° C. The mixture was refluxed for 1 hour and the solvent was evaporated. A yield of 182 grams of a black, viscous product was obtained. This yield is approximately 100 per cent of the theoretical.

EXAMPLE 3

300 ml of dichloromethane and 40 grams or 0.45 moles of dry 1,4-dioxane were placed in a 1 liter, three-neck flask equipped with a mechanical stirrer, thermometer, gas inlet tube, condenser, and a gas bubbler. The contents were cooled to −20° C. During one hour, 37.0 grams or 0.396 moles of sulfur trioxide was distilled into the flask under a stream of argon. 50.0 Grams or 0.187 mole of a mixture of alpha olefins of from about 18 to about 20 carbon atoms was added rapidly to the white suspension and the mixture stirred at a temperature from about −5° to about −20° C. for 1 hour. 46.0 grams of 1,6-hexane diamine was added at such a rate that the temperature in the flask did not exceed 8° C. The mixture was fully heated to reflux and refluxed for 1 hour. A clear, amber product of approximately 100 percent yield was obtained. The product was soluble in n-hexane, kerosene, jet fuel, dichloromethane, and benzene.

TABLE I

| Conductivities of Compositions | | | |
|---|---|---|---|
| Agent | Fuel | Test Conductivity at 74° C Picosiemens | Concentrations |
| Agent of Example 1 | Jet JP-4 | 50 | 56 |
| Agent of Example 2 | Jet JP-4 | 50 | 3 |
| Agent of Example 3 | Jet JP-4 | 50 | 0.5 |

Many variations from these examples are possible. These examples are illustrations of specific compositions prepared in the laboratory. Those skilled in the art will be able to prepare many equivalent compositions. The examples shown should not be used in determining the scope of the invention.

I claim:

1. A hydrocarbon composition having properties which prevents static charge buildup comprising a major proportion of a hydrocarbon and an effective amount of an antistatic additive of the general formula $$R_1—\underset{\underset{HNR_2}{|}}{CH}—CH_2—SO_3H$$

wherein $R_1$ is an alkyl or alkenyl group of 1 to 24 carbon atoms, and $R_2$ is a hydrocarbon group with less than 18 carbon atoms, a radical of the general formula $$—(CH_2)_xNH\ yH$$

wherein $x$ is a number ranging from 1 to 6 and $y$ is a number ranging from 1 to 5, a radical represented by the general formula $$—(CH_2)_z—NH—R_3$$

wherein $z$ is a number ranging from 1 through 5 and $R_3$ is an alkyl or alkenyl group containing 1 to 24 carbon atoms or hydrogen.

2. The composition of claim 1 wherein the antistatic additive is represented by the formula $$CH_3(CH_2)_{17}—\underset{\underset{NH—C_2H_4—NH—C_2H_4—NH_2}{|}}{CH}—CH_2—SO_3H$$

3. The composition of claim 1 wherein the antistatic additive is represented by the formula $$CH_3(CH_2)_{15}—\underset{\underset{\underset{H}{N}—(CH_2)_3—N—R}{|}}{CH}—CH_2SO_3H$$

wherein R is an alkyl or alkenyl group containing 12 to 14 carbon atoms.

4. The composition of claim 1 wherein the antistatic additive is represented by the formula

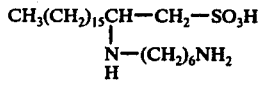

5. A product of the process comprising contacting about 0.1 to about 2.0 moles of sulfur trioxide and from about 0.1 to about 2 moles of a complexing agent in an inert solvent at an original temperature below −10° C. contacting this resultant mixture with from about 0.1 to about 2 moles of an alpha olefin at the same low temperature, then contacting this mixture with about 0.1–2.0 moles of an amine, raising the temperature to from about 10° to about 95° C. for 1 minute to about 10 hours, the removing the solvent and recovering the antistatic additive.

6. The process of claim 5 wherein the complexing agent is selected from a group consisting of 1,4-dioxane, diethyl ether, or dimethyl formamide.

7. The process of claim 5 wherein the original temperature is from about −30° to about +20° C.

8. The process of claim 5 wherein the alpha olefin is an unsaturated hydrocarbon of from about 8 to about 24 carbon atoms.

9. The process of claim 8 wherein the alpha olefin is an unsaturated hydrocarbon of from about 18 to about 20 carbon atoms.

10. The process of claim 5 wherein the amine is selected from a group consisting of ammonia, N-alkyl-1,3-propylene diamine, N-alkenyl-1,2-propylene diamine diethylene triamine, triethylene tetramine, and tetraethylene pentamine.

11. The process of claim 5 wherein the temperature is raised to about 30° to about 50° C. for a period of 45 minutes to 2 hours.

* * * * *

UNITED STATES PATENT OFFICE

CERTIFICATE OF CORRECTION

Patent No. 4,113,443 Dated September 12, 1978

Inventor(s) J. Ronald Spence

It is certified that error appears in the above-identified patent and that said Letters Patent are hereby corrected as shown below:

| Patent Column | Patent Line | |
|---|---|---|
| 1 | 63 | "substituted" should be -- substituent --. |
| 4 | 42 | "used in heating and as diesel fuel oils" -- omit; repeated --. |
| 5 | 24 | "while" should be -- white --. |
| 5 | 29 | "ap" should be -- at --. |
| 5 | 46 | "Armak" should be -- Arma-K --. |

UNITED STATES PATENT OFFICE
CERTIFICATE OF CORRECTION

Patent No. 4,113,443 Dated September 12, 1978

Inventor(s) J. Ronald Spence

It is certified that error appears in the above-identified patent and that said Letters Patent are hereby corrected as shown below:

7 1 "$CH_3(CH_2)_{15}CH-CH_2SO_3H$
$N-(CH_2)_6NH_2$ should be:

$CH_3(CH_2)_{15}-CH-CH_2-SO_3H$
$N(CH_2)_6NH_2$
H Claim 6

7 19 "the removing" should be --then removing--.

Signed and Sealed this

Nineteenth Day of June 1979

[SEAL]

Attest:

RUTH C. MASON
Attesting Officer

DONALD W. BANNER
Commissioner of Patents and Trademarks